US007967498B2

(12) United States Patent
Van Den Berg

(10) Patent No.: US 7,967,498 B2
(45) Date of Patent: Jun. 28, 2011

(54) SUBMERSIBLY OPERABLE HIGH VOLUME AND LOW PRESSURE LIQUID TRANSFER EQUIPMENT

(76) Inventor: Zacharias Joseph Van Den Berg, Glenharvie (ZA)

( * ) Notice: Subject to any disclaimer, the term of this patent is extended or adjusted under 35 U.S.C. 154(b) by 1107 days.

(21) Appl. No.: 10/582,287

(22) PCT Filed: Dec. 10, 2004

(86) PCT No.: PCT/ZA2004/000155

§ 371 (c)(1),
(2), (4) Date: Jan. 11, 2007

(87) PCT Pub. No.: WO2005/093261

PCT Pub. Date: Oct. 6, 2005

(65) Prior Publication Data

US 2007/0183257 A1 Aug. 9, 2007

(30) Foreign Application Priority Data

Dec. 10, 2003 (ZA) ..... 2003/9329

(51) Int. Cl.
*B01F 7/26* (2006.01)
*B01F 15/02* (2006.01)

(52) U.S. Cl. ..... 366/136; 366/264; 366/317

(58) Field of Classification Search ..... 366/136–137, 366/101, 106–107, 262–265, 270, 315–317
See application file for complete search history.

(56) References Cited

U.S. PATENT DOCUMENTS

| | | | | |
|---|---|---|---|---|
| 3,572,649 | A * | 3/1971 | Joel | 366/136 |
| 4,416,549 | A * | 11/1983 | Kretschmer | 366/190 |
| 4,499,562 | A * | 2/1985 | Campolini et al. | 366/264 |
| 4,534,654 | A * | 8/1985 | Alt et al. | 366/264 |
| 5,501,523 | A * | 3/1996 | Weetman et al. | 366/263 |
| 5,505,541 | A * | 4/1996 | Kihara | 366/264 |
| 2007/0183257 | A1 * | 8/2007 | Van Den Berg | 366/264 |

FOREIGN PATENT DOCUMENTS

NL 9101272 * 2/1993

* cited by examiner

*Primary Examiner* — Charles E Cooley
(74) *Attorney, Agent, or Firm* — Wyatt, Tarrant & Combs, LLP

(57) ABSTRACT

Submersibly installable and operable high volume and low pressure stirrer type liquid transferring equipment comprises a rotor type stirrer driven via a drive shaft passing without making contact along a sleeve rooting centrally in a housing having a downwardly facing inlet and a tangentially arranged outlet. As the casing of the housing is independent of the remainder of the equipment it is fitted with elevating leg plates. Its operative location is accommodated by a location of equipment installation. The stirrer is bolted to a drive assembly via its shaft. The length of the sleeve is established in conjunction with the circumstances of use of the equipment to maintain the zone encompassed by the housing sealed from above by a liquid seal.

23 Claims, 4 Drawing Sheets

SUBMERSIBLY OPERABLE HIGH VOLUME AND LOW PRESSURE LIQUID TRANSFER EQUIPMENT

CROSS REFERENCE TO RELATED APPLICATIONS

This application claims priority of PCT/ZA2004/000155 filed Dec. 10, 2004, and South Africa Provisional Patent Application No. 2003/9329 filed Dec. 10, 2003.

STATEMENT REGARDING FEDERALLY SPONSORED RESEARCH OR DEVELOPMENT

Not Applicable

REFERENCE TO A "MICROFICHE APPENDIX"

Not Applicable.

BACKGROUND TO THE INVENTION

Conditions are often encountered where a large volume of liquid is desired to be recirculated and/or transferred against a small head such as the passing of sludge and liquid through a sewage plant. As it is desirable to retain the power consumption in achieving such transfer and circulation to as low a rate as possible it is, amongst others, an object of this invention to address this aspect.

PRIOR ART DESCRIPTION

The transfer and recirculation of liquid in a sewage treatment plant is achieved by way of conventional pumping equipment of which the normal function is to transfer liquid against a large head. The use of such equipment even if used under conditions of transferring against a small head consumes substantial power.

SUMMARY OF THE INVENTION

This invention relates to a submersibly operable high volume and low pressure liquid transfer facility and to a layout and installation involving its use. Although not in any way so limited the invention is usefully applicable in the case of sewage treatment.

DETAILED DESCRIPTION OF THE DRAWINGS

Figure 2:
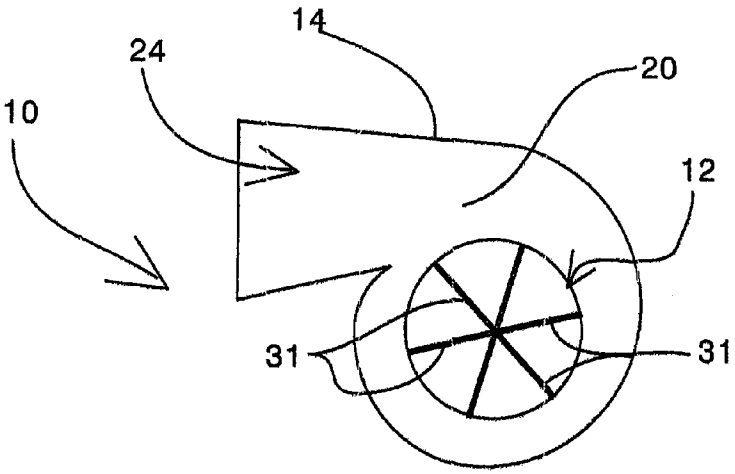
FIG. 2 is a top plan view of the high volume, low pressure pump of the present invention along line 2-2 of FIG. 1.

Referring to FIGS. 1 to 4 of the drawings a submersibly operable high volume and low pressure liquid transfer facility in the form of stirrer type transferring equipment is generally indicated by reference numeral 10.

The equipment 10 comprises a rotor type stirrer 12 situated to freely rotate in a horizontal plane within a housing 14, once the equipment 10 is operatively installed, via an upright stirrer drive shaft 16 as passing along an upwardly extending enclosure in the form of a sleeve 18 rooting centrally in the housing 14. The housing 14 thus defines a liquid transfer Zone 20 extending between a downwardly facing axially arranged inlet 22 and a tangentially arranged outlet 24. The zone 20 extends in a liquid flow promoting way owing to the housing 14 being generally formed like the housing of a centrifugal pump.

The housing is constituted from a casing 26 fitted with a releasable upper cover 28 that is integrally formed with the sleeve 18. The sleeve 18 thus extends above the housing 14 once the equipment 10 is operatively installed rendering the zone 20 open from above.

Figure 3:
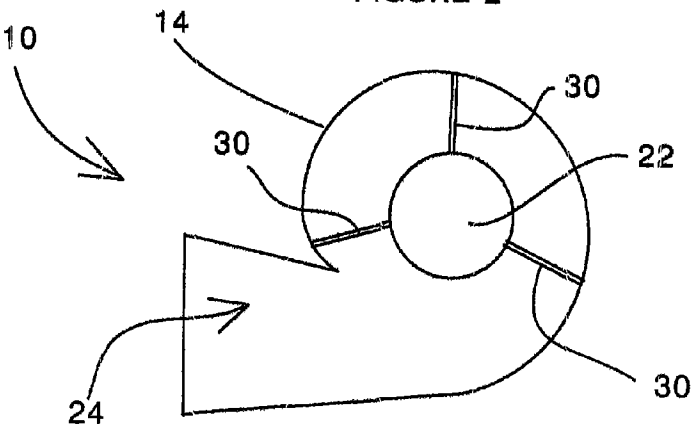
FIG. 3 is a bottom plan view of the high volume, low pressure pump of the present invention along line 2-2 of FIG. 1.
Figure 1:
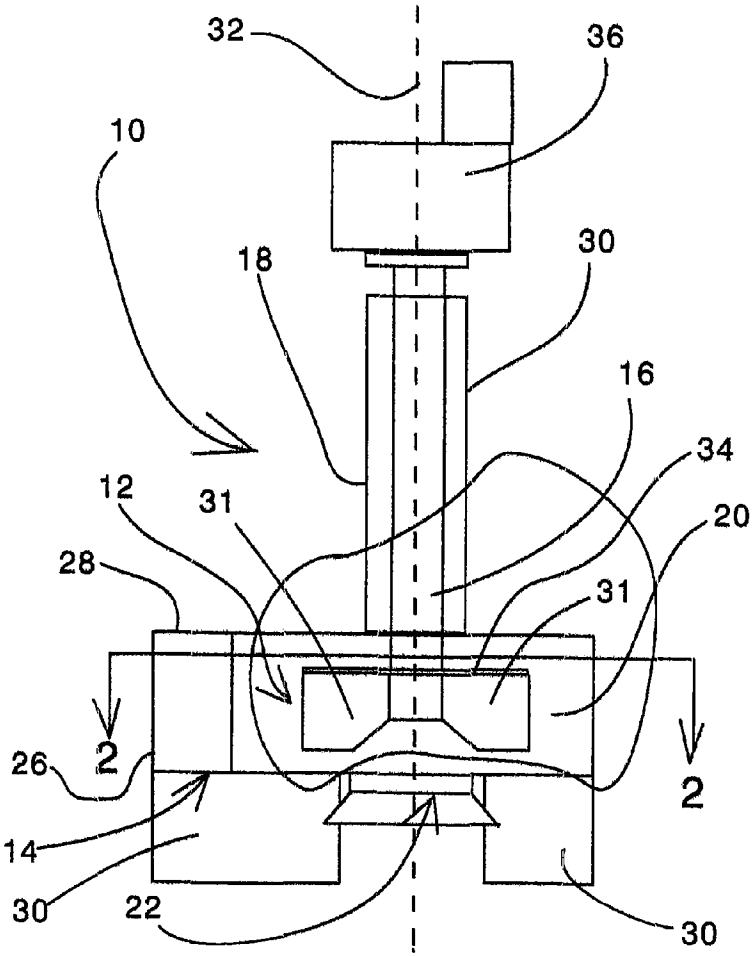
FIG. 1 is a cross sectional side elevation of one embodiment of the high volume, low pressure pump of the present invention.

The casing 26 is independent from the stirrer 12 and the cover 28. To accommodate the inlet 22 to the zone 20 the casing 26 is fitted with elevating means in the form of leg plates 30 extending radially between the periphery of the housing 14 and the edge of the inlet 22 as shown in FIG. 3.

The stirrer 12 is formed with stirrer blades 31 that are regularly arranged about its axis of rotation 32. The blades 31 are integrally mounted to a blade carrier 34 from the remote side of which the shaft 16 extends. The stirrer 12 is rotatably driven from a drive in the form of an overhead mounted gearbox and motor assembly 36 that does not necessarily form part of the equipment 10 and that is selected for driving the stirrer 12 at a conventional stirrer type speed of rotation. As the stirrer 12 is freely suspended within the housing 14 it is so operatively maintained by being bolted to the drive assembly 36 via its shaft 16.

The height of the sleeve 18 is established in conjunction with the circumstance of use of the equipment 10 to maintain the zone 20 sealed from above by a liquid seal while the shaft 16 and stirrer 12 runs without in any way making contact with the sleeve 18 or the housing 14.

Figure 4:
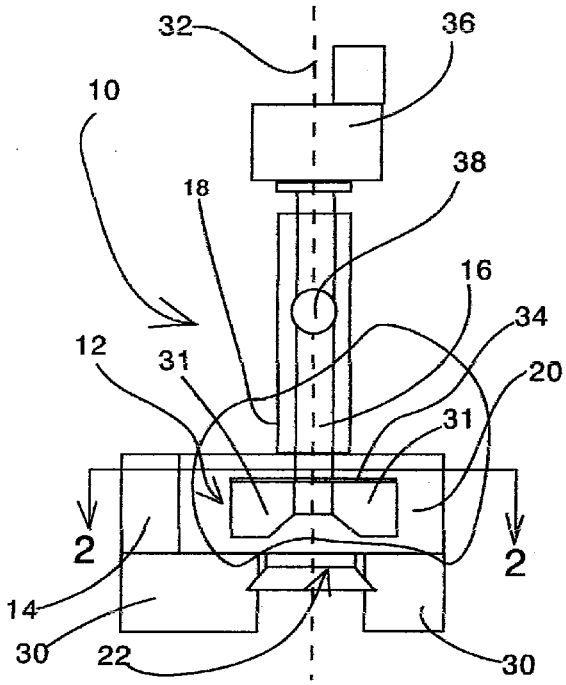
FIG. 4 is a cross sectional side elevation of an alternative embodiment of the high volume, low pressure pump of the present invention.

Referring also to FIG. 4 the sleeve 18 presents a charging pipe connection 38 to which an equipment charging pipe (not shown) is sealably connectable by being boltable thereto for charging the zone 20 from a position along the sleeve 18. The location of the connection 38 along the sleeve 18 is pre-established under conditions of use of the equipment 10 to the effect of gravitationally charging the zone 20 from a source of which the liquid level is lower than that of the vessel in which the equipment 10 is positioned but still above the elevation of liquid in the sleeve 18 once the equipment 10 is in operation.

This effect is naturally brought about by suction action of the stirrer 12 on the liquid column in the sleeve 18.

Figure 6:
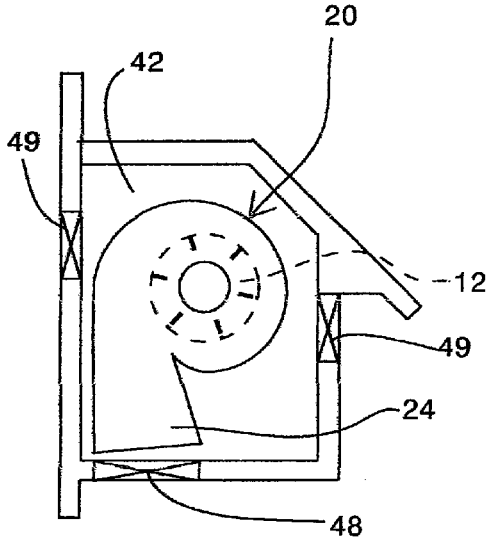
FIG. 6 is a top plan view of the liquid recirculation and transfer apparatus of the present invention.
Figure 5:
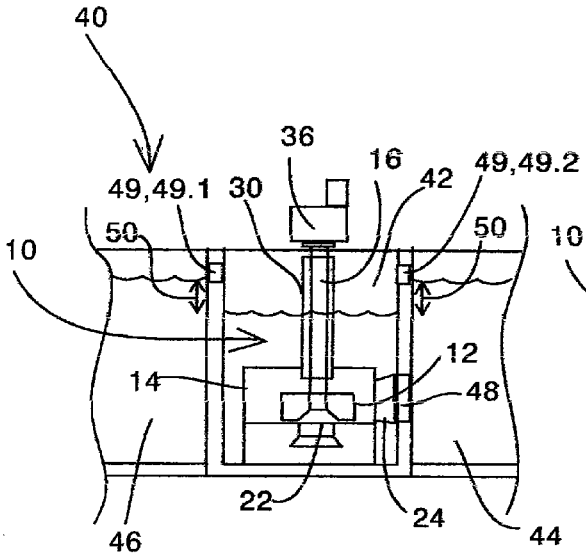
FIG. 5 is a cross sectional side elevation of one embodiment of the liquid recirculation and transfer apparatus of the present invention.
Figure 7:
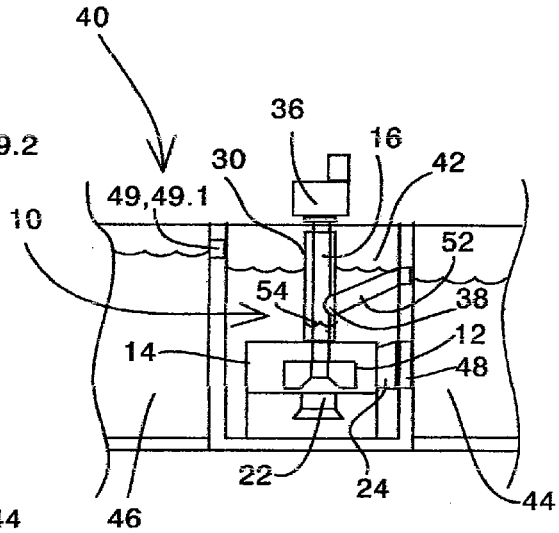
FIG. 7 is a cross sectional side elevation of an alternative embodiment of the liquid recirculation and transfer apparatus of the present invention.

Referring also to FIGS. 5 to 7 the equipment 10, as of high volume and low-pressure characteristics, is thus installable for re-circulating liquid in a liquid recirculation and transfer vessel layout generally indicated by reference numeral 40. The layout 40 comprises a liquid transfer facility holding vessel in the form of an equipment holding vessel 42, a re-circulation vessel 44 and a recirculation-cum-charging vessel 46.

Although not shown the casing 26 is installed by way of anchoring guides extending upward from the floor of the vessel 42 that promote the ease of retraction of the equipment 10 by simply lifting it away.

As more clearly shown in FIG. 6 the equipment 10 is naturally installed with its outlet 24 facing an equipment holding vessel discharge in the form of a discharge port 48 situated at a low level while its inlet 22 faces downward. The vessels 42, 44 and 46 are interconnected by high elevation charging ports 49 permitting the gravitational return flow or charging of liquid to the vessel 42. While not shown the size of the ports 49 are controllable by sluice gates.

The object of the layout 40 is to transfer liquid against a small head inclusive of a circulatory transfer between the vessels 42 and 44, 46. As operation of the equipment 10 has the effect of drawing the level in the vessel 42 below that of the levels in the vessels 44, 46, as shown in FIG. 5, a positive hydrostatic head 50 is created in the direction of the vessel 42. This causes liquid to continuously flow from the vessels 44, 46 to the vessel 42 via the ports 49 once the equipment 10 is running. In practice the layout 40 will normally be used in a continuous process. To this effect the vessel 42 can either be charged from a pipe (not shown) or the vessel 46 can be a charging vessel. In either case the various levels will automatically stabilize once the vessel layout 40 is running. Under such stabilized running conditions fresh liquid will continuously gravitate from the vessel 46 via its charging port 49.1 to the vessel 42 while continuous recycling of liquid will take place between the vessels 44 and 42 via the port 49.2. A flow equal to the charging will naturally be discharged from the vessel 44 via its discharge (not shown).

In referring to FIG. 7 in conjunction with FIG. 4 in a case where the FIG. 4 embodiment of the equipment 10 is used the vessel 44 and even the vessel 46 (not shown) can be in flow communication with the vessel 42 via a pipe 52 that is connected to the connection 38 of the sleeve 18. The inlet to the pipe 52 is at a high elevation to the vessel 44 that is however below the operating level of liquid in the vessel 42. The outlet from the pipe 52 is however above the liquid level 54 in the sleeve 18 under conditions of operation of the layout 40 as already discussed. This has the effect that liquid can still gravitate from the vessel 44 to the vessel 42 despite having a lower liquid level. Except for the flow conditions created by the pipe 52 the operation of the FIG. 7 embodiment of the layout 40 is similar to that of the FIGS. 5 and 6 embodiment. It will be appreciated that the location of the pipe connection 38 must be established under the conditions of use of the layout 40.

Figure 8:
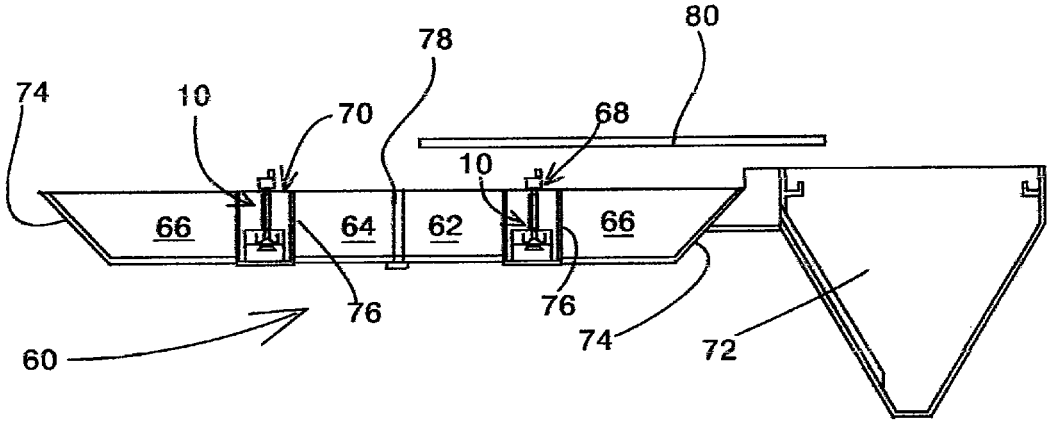
FIG. 8 is a sectional view of an example of a water treatment installation utilizing the high volume, low pressure pump of the present invention along line 8-8' of FIG. 9.
Figure 10:
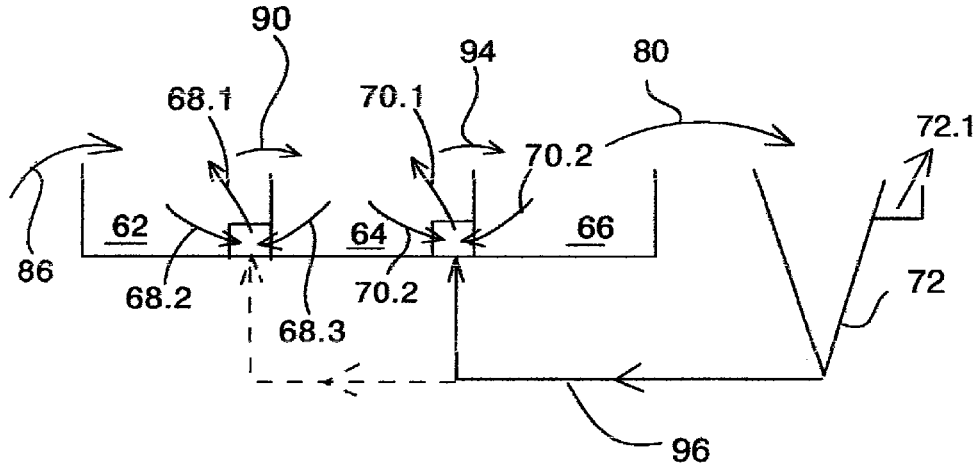
FIG. 10 is a flow diagram of a water treatment process utilizing an example of a water treatment installation utilizing the high volume low pressure pump of the resent invention.
Figure 9:
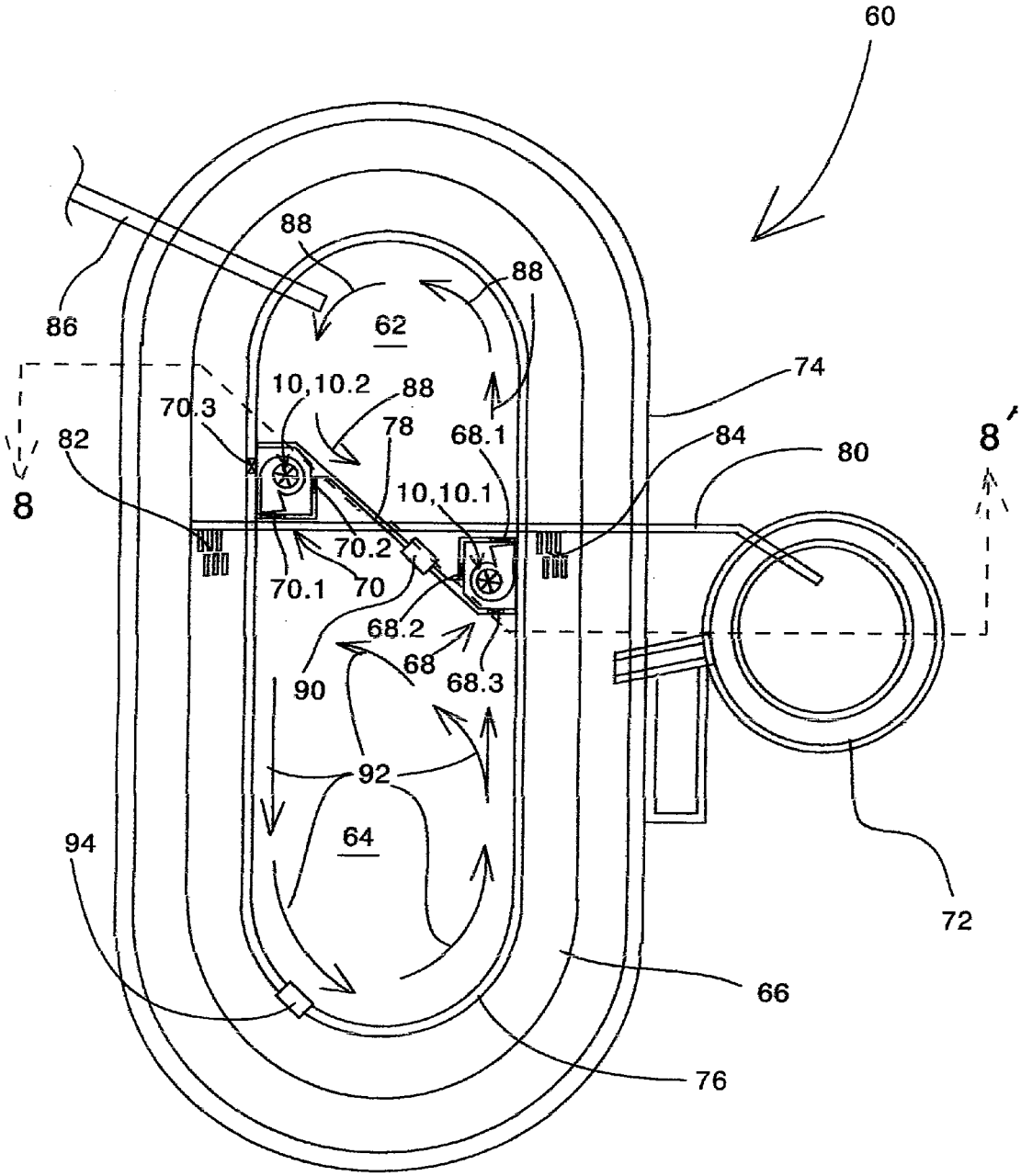
FIG. 9 is a top plan view of an example of a water treatment installation utilizing the high volume, low pressure pump of the present invention.

In further referring to FIGS. 8 to 10 the layout 40 is usefully employable under conditions of water treatment and especially the treatment of sewage.

A sewage treatment installation 60 is constituted from a primary treatment vessel 62, an intermediate treatment vessel 64, a discharge vessel in the form of a final treatment vessel 66, a pair of equipment holding vessels in the form of equipment holding sumps 68, 70 and a separator vessel 72. In this vessel layout the sumps 68, 70 concur with the equipment holding vessel 42 of FIGS. 5 and 6 and the vessels 62, 64 and 66 with the vessels 44, 46.

The installation 60 presents a generally oval structure having a peripheral outer wall 74, and an inner wall 76 spaced inwardly there from between which walls 74, 76 the vessel 66 is defined. A transverse wall 78 extends obliquely across the oval formation defined within the inner wall 76 dividing it into the vessels 62 and 64. The equipment 10 contained by the sumps 68, 70 connects discharge fashion with each vessel 62 and 64 respectively. The sumps 68, 70 have outlet ports 68.1, 70.1 and adjustable inlet ports in the form of first adjustable inlet sluices 68.2, 70.2 and second adjustable inlet sluices 68.3, 70.3 for varying the flow rates of liquid into the sumps 68,70. The sumps 68 and 70 are small in volume in comparison with their associated reactor vessels 62 and 64.

Adjustment of the gates of the sluices 68.2, 68.3 and 70.2 and 70.3 and operation of the equipment 10 result in a lowering in the level of liquid in the sumps 68, 70 causing positive hydrostatic liquid heads between the liquid in the primary and intermediate treatment vessels 62 and 64 and the sump 68, on the one hand, and between the intermediate and final treatment vessels 64 and 66 and the sump 70 on the other hand. The hydrostatic heads causes liquid to flow from the vessel 62 though the inlet-sluice 68.2 into the sump 68 and from the vessel 64 though the inlet-sluice 70.2 into the sump 70 respectively. The equipment 10 in each sump 68, 70 returns liquid through the respective outlet ports 68.1, 70.1 into the vessels 62 and 64 respectively again in a circulatory manner thereby providing a mixing liquid flow stream. In addition liquid from the vessel 64 can be permitted to flow to the sump 68 via the sluice 68.3 and from the vessel 66 to the sump 70 via the sluice 70.3 to expand the circulatory effect.

To promote a flow of liquid from the vessel 62 to the vessel 64 the gates of the sluices 68.2, 70.2, 68.3, 70.3 are appropriately adjusted. While not specifically described under this embodiment the FIG. 7 layout can be usefully employed for maintaining a return flow of liquid from the vessel 64 to the vessel 62 via the sluice 68.3 even though the level of liquid in the vessel 64 is lower than that in the sump 68 during operation of the installation 60. The same applies for a flow between the vessel 66 and the vessel 64 via the sump 70.

The installation 60 further includes an elevated launder 80 fed by aerators 82 and 84 dipping into the surface of the liquid in the vessel 66. The aerators 82, 84 thereby raise liquid and sludge into the launder 80 which then conveys such liquid and sludge and discharges it into the separator vessel 72.

In using the installation 60 as sewage treatment plant a primary treatment zone is defined within the vessel 62, a secondary treatment zone within the vessel 64 and a tertiary treatment zone within the vessel 66. Anaerobic treatment takes place in vessel 62, anoxic treatment in vessel 64 and aerobic treatment in vessel 66. It will be appreciated that the specific physical installation may be used or adapted to suit the treatment protocol required.

In use, raw liquid to be treated is fed into the primary treatment vessel 62 via inlet pipe 86. The equipment 10 in the sump 68 displaces liquid from the sump 68 via the outlet port 68.1, in the direction of arrows 88 within the reactor vessel 62, thereby to mix the contents of the first treatment zone. The liquid is returned to the sump 68, via the adjustable sluice 68.2, for recirculation. Treated liquid flows from the first treatment vessel 62 into the second treatment vessel 64 via an overflow 90. Recycled liquid from the vessel 64 can also pass into the sump 68 via the port 68.3 for transfer into the vessel 62.

Similarly the equipment 10 of the sump 70 displaces liquid from the sump 70 via the outlet port 70.1 in the direction of the arrows 92 in the vessel 64, thereby to mix the contents of the secondary treatment zone. The liquid is returned to the sump 70 via the adjustable inlet sluice 70.2 for recirculation. Treated liquid flows from the vessel 64 into the vessel 66 via an overflow 94. Recycled liquid from the vessel 66 can also pass into the sump 70 via the inlet port 70.3 for transfer into the vessel 64.

By suitably adjusting the gates controlling the flow through the various ports, it is possible to obtain various levels of liquid within the various treatment zones and thereby obtaining variation in the degree of circulation within the zones, and recirculation and transfer of liquid between various zones.

Clarified liquid overflows from the separator vessel 72 as indicated by arrow 72.1 shown in FIG. 10. Sludge may be recirculated if desired, from the bottom of the vessel 72, along the flow conduit 96 to the sumps 62 and 64.

While the installation 60 is described with the reference to the equipment of FIGS. 5 and 6 it will be appreciated that the FIG. 4 embodiment of the equipment and thus FIG. 7 embodiment of the layout 40 can equally be used with the necessary adjustments.

It is an advantage of the aspect of the invention in the form of the equipment 10 as specifically described that a relatively large volumetric flow of liquid though at a low pressure is achievable by means of stirrer type equipment that require very little maintenance and run at a low consumption of power. The advantages brought about by the device 10 are thus usefully applicable under appropriate systems such as in sewage treatment plants.

What is claimed is:

1. A liquid recirculation and transfer system capable of transferring liquid against a small head comprising:

an equipment holding vessel for containing liquid having an enclosed bottom, an open top, at least one side wall connected to said bottom, the sidewall having a discharge port positioned adjacent said bottom for transferring liquid out of the holding vessel and an intake port positioned adjacent the open top;

a high volume, low pressure liquid transfer assembly comprising a rotor type stirrer having a stirring blade connected to a first end of a shaft and mounted within the equipment holding vessel such that a second end of the shaft is above the top of the vessel;

a submersible housing surrounding said stirring blade and defining a liquid transfer zone, the shaft of the stirrer traversing the housing through a shaft opening in the housing, the stirrer freely rotatable within the housing, the housing positioned within the holding vessel such that the housing is at least partially submersed in liquid when the holding vessel is charged, the housing having a liquid intake for drawing liquid into the housing and a liquid discharge tangential to the housing and aligned with said discharge port for pumping liquid out of the housing; and a drive mounted adjacent the top of the holding vessel engaged with the second end of the shaft of the stirrer such that said drive is capable of rotating the stirrer.

2. The liquid recirculation and transfer system of claim 1 further comprising:

a recirculation vessel capable of containing liquid adjoining the equipment holding vessel, the discharge port connected to the recirculation vessel adjacent a bottom of the recirculation vessel and the intake port connected to the recirculation vessel adjacent a top of the recirculation vessel whereby liquid pumped out of the holding vessel through the discharge port enters the recirculation vessel and liquid in the recirculation vessel enters the holding vessel through the intake port by gravitational flow.

3. The liquid recirculation and transfer system of claim 2 further comprising:

a valve intermediate the recirculation vessel and the intake inlet port for controlling recirculation of the fluid.

4. The liquid recirculation and transfer system of claim 3 wherein:

the valve is a sluice gate.

5. The liquid recirculation and transfer system of claim 2 further comprising:

a sleeve having a top end and a bottom end capable of containing a liquid, the sleeve surrounding the shaft and extending from the shaft opening of the housing, the top end of the sleeve open, the bottom end of the sleeve adjacent the housing, the sleeve of a predetermined length and width sized to maintain a liquid level in the sleeve thus creating a liquid seal for the housing.

6. The liquid recirculation and transfer system of claim 5 further comprising:

a charging pipe opening in the sleeve positioned above the preset sleeve liquid level; and a charging pipe having a first end connected to the intake port and a second end connected to the charging pipe opening for transferring recirculated liquid from the recirculation vessel to the sleeve thereby enabling gravitational return flow from the recirculation vessel to the holding vessel even if the liquid level in the holding vessel is greater than the liquid level in the recirculating vessel.

7. The liquid recirculation and transfer system of claim 2 further comprising:

a charging port in the equipment holding vessel positioned adjacent the open top of the holding vessel for transferring liquid into the holding vessel; and a charging vessel capable of containing liquid adjoining the equipment holding vessel, the charging port connected to the charging vessel adjacent a top of the charging vessel whereby liquid from the charging vessel flows through the charging port into the holding vessel by gravitational flow.

8. The liquid recirculation and transfer system of claim 7 further comprising:

a valve intermediate the charging vessel and the charging port for controlling flow of the liquid into the holding vessel.

9. The liquid recirculation and transfer system of claim 8 wherein:

the valve is a sluice gate.

10. The liquid recirculation and transfer system of claim 7 wherein:

the charging port is connected to the recirculation vessel adjacent the top of the recirculation vessel whereby liquid from the recirculation vessel flows through the charging port into the holding vessel by gravitational flow.

11. The liquid recirculation and transfer system of claim 2 further comprising:

a second recirculation vessel having an open top and a second high volume, low pressure liquid transfer assembly, an overflow from the first recirculation vessel to the second recirculation vessel, a discharge overflow from the second recirculation vessel, and a discharge vessel into which the overflow from the second recirculation vessel discharges once the system is in use.

12. The liquid recirculation and transfer apparatus of claim 11 further comprising:

a second adjustable holding vessel intake port positioned adjacent the open top of the holding vessel by means of which the discharge vessel is in adjustable return flow communication with the second recirculation vessel.

13. The liquid recirculation and transfer apparatus of claim 11 further comprising a second adjustable holding vessel intake port positioned adjacent the open top of the first holding vessel by means of which the second recirculation vessel is in adjustable return flow communication with the first recirculation vessel via the first holding vessel.

14. The liquid recirculation and transfer system of claim 11 wherein:

the first recirculation vessel is chargable by means of a charging pipe that discharges into the first recirculation vessel.

15. The liquid recirculation and transfer system of claim 11 further comprising:

a separator vessel in communication with the discharge vessel via a channel that is fed by an aerator whereby the system is used for the treatment of sewage.

16. The liquid recirculation and transfer system of claim 1 wherein:

the stirrer blade comprises a circular blade carrier perpendicular to the first end of the shaft and fixed thereto, said stirrer blade having a plurality of rotor blades extending radially about the circumference of the blade carrier, the blade carrier perpendicular to the shaft.

17. The liquid recirculation and transfer system of claim 1 further comprising:

an elevating means for supporting the housing above the bottom of the holding vessel intermediate the bottom of the holding vessel and the housing wherein the liquid intake is positioned on a bottom of the liquid transfer assembly, the intake being axially aligned with the stirrer and having a diameter smaller than the diameter created by the rotation of the stirrer blade.

18. The liquid recirculation and transfer system of claim 17 wherein:

the elevating means comprises at least one support member affixed to the bottom of the equipment holding vessel and attached to the housing.

19. The liquid recirculation and transfer system of claim 1 further comprising:

a sleeve having a top end and a bottom end capable of containing a liquid, the sleeve surrounding the shaft and extending from the shaft opening of the housing, the top end of the sleeve open, the bottom end of the sleeve adjacent the housing, the sleeve of a predetermined length and width sized to maintain a liquid level in the sleeve thus creating a liquid seal for the housing.

20. The liquid recirculation and transfer system of claim 19 wherein:

the width of the sleeve is sized such that the sleeve liquid level remains above the housing even if the sleeve liquid level drops below the liquid level in the holding vessel.

21. The liquid recirculation and transfer system of claim 19 further comprising:

a charging pipe opening in the sleeve positioned above the preset sleeve liquid level; and a charging pipe having a first end connected to the intake port and a second end connected to the charging pipe opening for transferring liquid to the sleeve.

22. The liquid recirculation and transfer system of claim 21 further comprising:

a recirculation vessel capable of containing liquid adjoining the equipment holding vessel, the discharge port connected to the recirculation vessel adjacent a bottom of the recirculation vessel and the intake port connected to the recirculation vessel adjacent a top of the recirculation vessel whereby liquid pumped out of the holding vessel through the discharge port enters the recirculation vessel and liquid in the recirculation vessel enters the holding vessel through the intake port by gravitational flow, a valve intermediate the recirculation vessel and the intake inlet port for controlling recirculation of the liquid.

23. The liquid recirculation and transfer system of claim 22 wherein:

the valve is a sluice gate.

* * * * *